United States Patent [19]

Zauderer et al.

[11] Patent Number: 4,624,191

[45] Date of Patent: Nov. 25, 1986

[54] AIR COOLED CYCLONE COAL COMBUSTOR FOR OPTIMUM OPERATION AND CAPTURE OF POLLUTANTS DURING COMBUSTION

[75] Inventors: Bert Zauderer, Merion; Vincent Tilli, Broomall, both of Pa.

[73] Assignee: Coal Tech Corp., Merion Station, Pa.

[21] Appl. No.: 681,875

[22] Filed: Dec. 14, 1984

[51] Int. Cl.[4] ..... F23D 1/02

[52] U.S. Cl. ..... 110/264; 110/265; 110/266

[58] Field of Search ..... 110/260–266, 110/246

[56] References Cited

U.S. PATENT DOCUMENTS

| | | | |
|---|---|---|---|
| 2,738,776 | 3/1956 | Burg | 110/265 |
| 2,777,407 | 1/1957 | Schindler | 110/266 |
| 2,881,720 | 4/1959 | Lotz | 110/266 |
| 2,957,436 | 10/1960 | Lotz | 110/265 |
| 2,971,480 | 2/1961 | Sage | 110/265 |
| 2,979,000 | 4/1961 | Sifrin et al. | 110/265 |
| 3,124,086 | 3/1964 | Sage et al. | 110/264 |
| 3,179,074 | 4/1965 | Clark et al. | 110/265 |
| 3,827,379 | 8/1974 | Tsurata et al. | 110/246 |
| 3,842,762 | 10/1974 | Sargent et al. | 110/246 |
| 4,492,171 | 1/1985 | Brashears et al. | 110/265 |

*Primary Examiner*—Henry C. Yuen

*Attorney, Agent, or Firm*—Robert C. Podwil

[57] ABSTRACT

An air-cooled cyclone coal combustor comprises a horizontally disposed shell, provided with a non-sacrificial refractory liner. The liner is surrounded by an array of air-cooling tubes, the tubes serving both to cool the liner and to physically support and reinforce it. Air cooling in the manner disclosed facilities precise control of the thickness and flow of slag on internal walls of the combustor, so as to avoid reevolution from the slag of the sulfur pollutants. Pulverized coal fuel and a pulverized sulfur sorbent (limestone or the like), as well as primary and secondary combustion air, are introduced into the chamber at an end wall. The cooling air, heated regeneratively in the cooling tubes, provides the secondary air, and is introduced in the chamber in helical flow, at a radius outwardly from the radius at which the solids and primary combustion air are introduced into the chamber. A thermally insulated nozzle provides an outlet for combustion gases.

26 Claims, 13 Drawing Figures

10
12
14
16
18
20
22
24
26
28
30
32
34
36
38
40
40c
54
55
58
64
66
68
69
70
72
74
76
77
78
79
80
82
84
86
87
88
98
100
102
116
118
3
4

FIG. 3
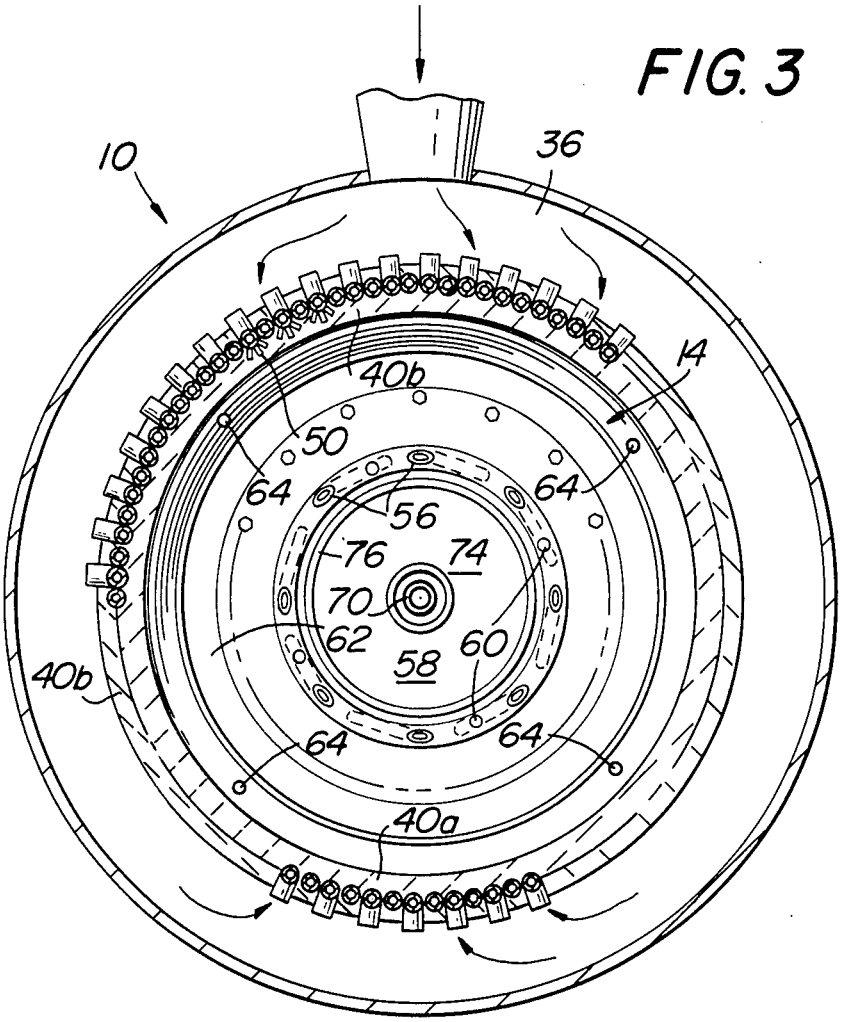
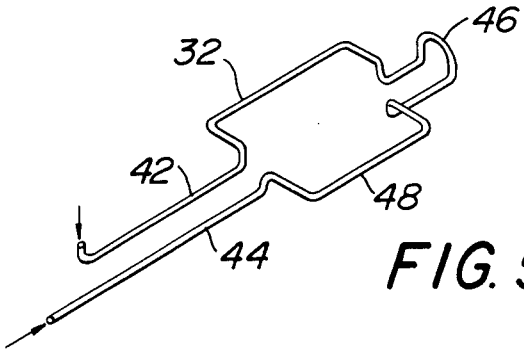
FIG. 5

FIG. 4
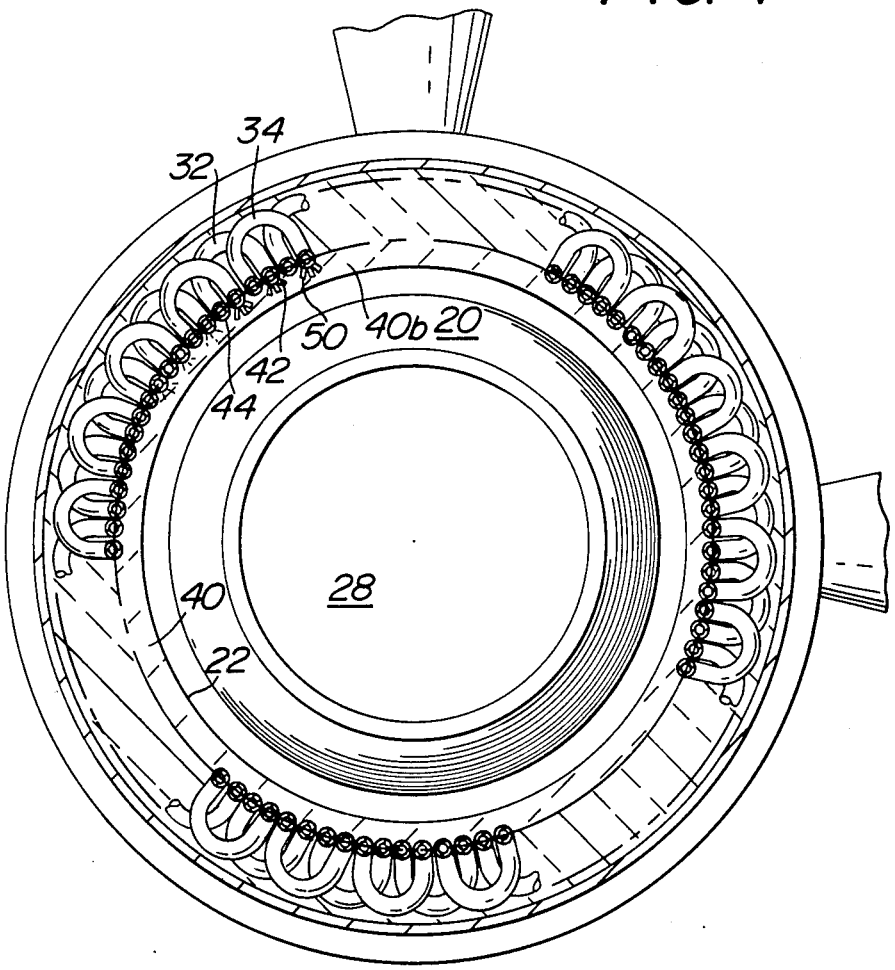
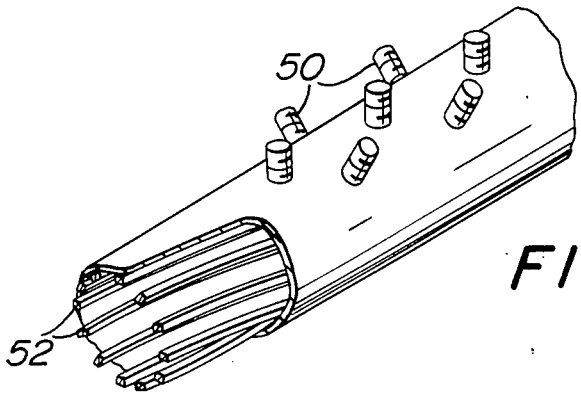
FIG. 6

FIG. 9
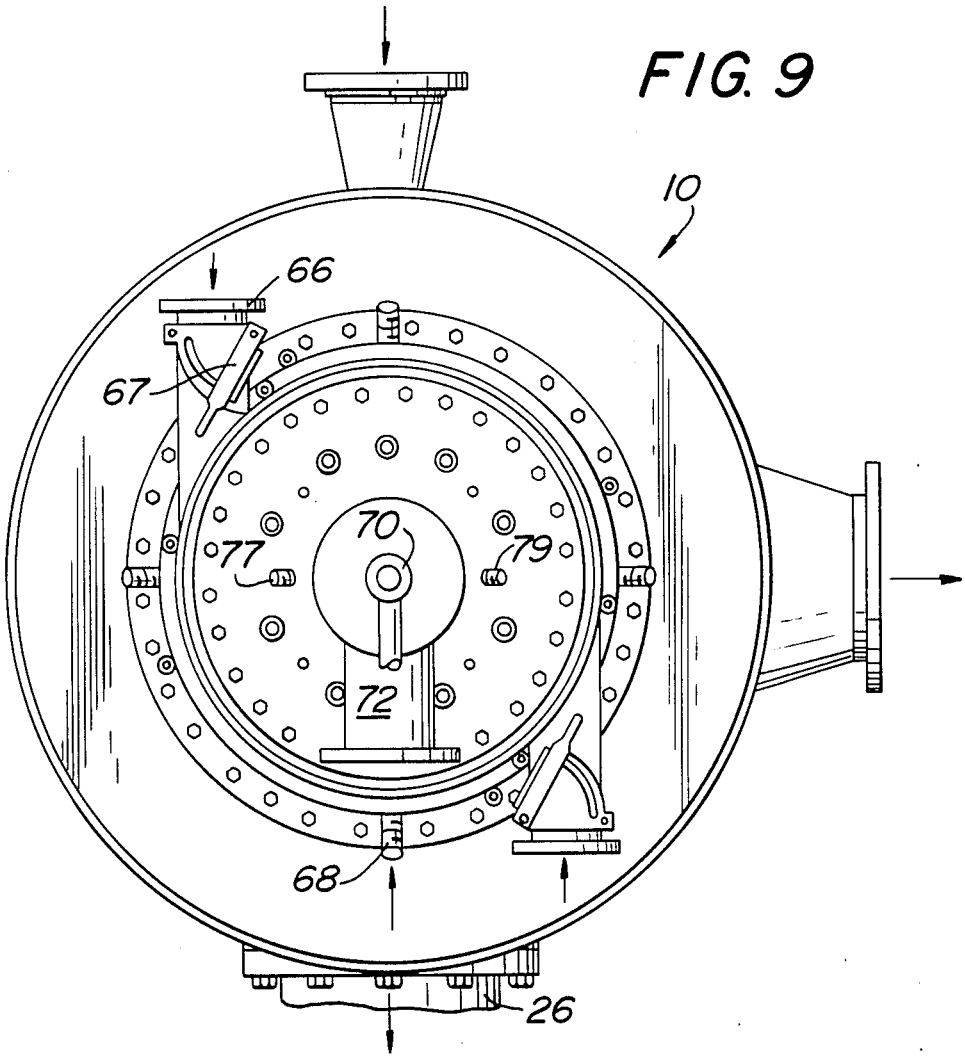
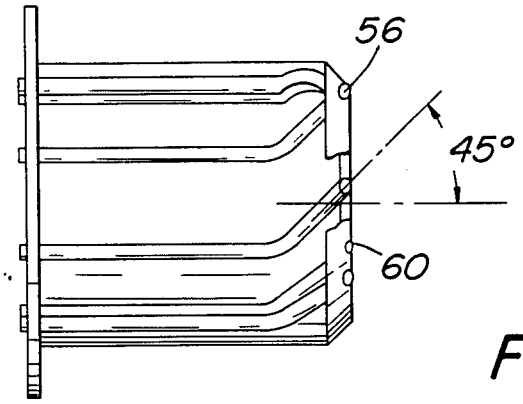
FIG. 10

AIR COOLED CYCLONE COAL COMBUSTOR FOR OPTIMUM OPERATION AND CAPTURE OF POLLUTANTS DURING COMBUSTION

BACKGROUND OF THE INVENTION

This invention relates to cyclone combustor apparatus, and more particularly, to air cooled apparatus for optimum combustion of coal, and the reduction, over conventional combustors, of the pollutants resulting from coal combustion. The present apparatus may be used to practice the processes described in a copending application entitled, "Method of Optimizing Combustion and the Capture of Pollutants during coal Combustion in a Cyclone Combustor", assigned to the assignee of the present application.

A cyclone coal combustor is, in general, a horizontal cylindrical device into which pulverized coal is injected with primary air, the air-coal mixture then to be centrifuged with secondary air toward the cylindrical wall of the cyclone. When coal particles burn while in suspension or on the wall of the cyclone in hot oxidizing gas temperature (at average temperatures around 3000° F.), the ash particles in the coal melt. Those in suspension are thrown to the wall. This liquified ash, called slag, rapidly coats the wall, and is continuously drained by the action of gravity toward the bottom and downstream end of the cyclone. There, in conventional practice, it is removed through a port called a slag tap.

In the above-mentioned copending application, it is disclosed that the separate injection of coal particles and limestone particles (both having an appropriate size range), and the injection of the air (at the proper temperature and swirling velocity, and in an amount to achieve a desired air/coal fuel ratio) will result in combustion inside the combustor under conditions in which: (1) the limestone reacts with and removes most of the sulfur gas compounds released by the coal; (2) almost all the slag released by the coal is retained on the wall for subsequent removal; and (3) the emission from the coal of the fuel-bound nitrogen compounds is controlled in a manner that will allow their subsequent conversion to nitrogen in the furnace to which the cyclone is attached.

While commercial horizontal cyclone combustors have heretofore been used to remove 70 to 85 percent of the coal ash, the processes disclosed in the above-mentioned copending application can achieve even higher ash removal, along with efficient nitrogen and sulfur pollutant control.

It is therefore a general object of the present invention to provide a combustor capable of practicing the processes disclosed in the above-mentioned copending application.

It is another object of this invention to provide an air-cooled cyclone coal combustor which is capable of (1) optimizing the combustion of the volatile and carbon compounds in coal; (2) maximizing the capture of gaseous compounds of sulfur, and (3) retaining solid and liquid particles from the gas stream before they are exhausted from the combustor.

As was explained in the above-mentioned copending application, an important feature needed to limit sulfur gas evolution from the slag and to prevent corrosive attack of the combustor walls is a thin, completely liquid slag layer, which flows relatively rapidly along the combustor's inner walls. With air cooling, one can maintain such a slag layer for a wide range of combustor operating conditions and different coal types. With water cooling, on the other hand, the slag layer tends to be thick, and frozen over most of its thickness due to contact with the water-cooled metal wall.

It has heretofore been proposed to (1) use in a cyclone coal combustor a non-sacrificial ceramic inner liner, to be coated during operation with a thin liquid slag layer, and (2) to use injection at the closed end of the cyclone of the coal, limestone and air streams. These features were first described in relation to a test program involving a 1 million BTU/hr coal capacity air cooled laboratory cyclone combustor. Later researchers found, however, that for a number of reasons, the design of the 1 million BTU/hr laboratory combustor (which had a 1 foot internal diameter and 2 feet internal length) could not simply be scaled up to commercial size combustors.

Specifically, the air cooled liner in the 1 million BTU/hour laboratory cyclone combustor used an externally grooved metal cylinder, which enclosed a liner made of ceramic cement. The grooves, which were parallel to the horizontal axis of the cyclone, carried the liner cooling air. While such a liner arrangement is satisfactory at 1 million BTU/hr, at larger sizes the different expansion coefficients of metal and ceramic cause the metal shell to separate from the ceramic in both the tangential and circumferential directions. This results in uneven liner cooling and liquid slag flow out of the combustion chamber at the upstream and downstream bottom edges of the liner, with attendant damage to the apparatus.

A second feature of the 1 million BTU/hour laboratory cyclone combustor which limits scale-up of its design is the method used for injection of the secondary combustion air. The secondary combustion air was injected at the closed end of the cyclone in a circle lying inside the coal injection circle. A series of helically curved swirl vanes directed the secondary air, but at about 70 million BTU/hr the air velocity required with such an arrangement approaches the speed of sound, resulting in an unacceptable pressure loss.

Another complicating factor in the design of a coal combustor is the fact that the liquid slag temperature required for optimum operation changes with coal type. With water cooling, the only method by which the cyclone can be adjusted to different coals and different operating conditions is changing of the slag layer thickness. Air cooling, however, provides more flexibility. An example of the flexibility of air cooling is given for the 1 million BTU/hour cyclone: A factor of two change in the air cooling mass flow rate changes the slag-ceramic interface temperature by 400° F. For a similar design with water cooling, a 50° F. temperature change requires a factor of three change in the water flow rate. While water cooling, which has been used in prior large commercial cyclones, can eliminate the liner expansion problem, it greatly limits the flexibility of the cyclone to operate in the optimum combustion and pollutant control mode with a wide range of coals.

Still another advantage of the air cooling in coal combustors is that the heat lost from the combution gases in the cyclone can be regenerated through the cooling air back into the combustor, with the cooling air being used as part of the secondary air supply.

The principles of present invention may be applied to combustors in size ranges from less than about one million BTU/hr to over 100 million BTU/hr, although the detailed description set forth below relates to a combustor rated at approximately 50 million BTU/hr at 15 percent excess air operation and 100 million BTU/hr at 70 percent of the stoichiometric air/fuel ratio.

BRIEF DESCRIPTION OF THE INVENTION

The foregoing and other objects of this invention are realized, in a presently preferred form of the invention, by a cyclone combustor which includes a cylindrical chamber, supplied with a non-sacrificial air-cooled ceramic lining assembly, the chamber providing an enclosure in which helical gas flow can be established. In a presently preferred form of the apparatus, the lining assembly was designed for 50,000 BTU/hr - $ft^2$ heat transfer, using internally finned metal cooling tubes.

The cooling tubes extend axially with respect to the chamber, at radially spaced locations around its outer periphery. High thermal conductivity and structural integrity of the lining assembly is achieved by using as the liner a ceramic cement, which is held in place by metal studs attached to the cooling tubes. The cooling tubes provide a structural support for the liner. Alternatively, a composite ceramic tile structure, backed by a ceramic cement, attached, in turn, to the metal studs, may be used.

In communication with the chamber is a slag tap through which liquid slag may flow for removal, and an outlet port through which combustion products may pass from the chamber to the boiler furnace box. The combustor may be mounted for selective tilting to maximize the slag removal rate and to facilitate control of the slag layer thickness or it may be provided with a bottom wall sloped toward the slag top.

Air is supplied to the air cooling tubes through the plenums or manifolds. The air is preferably heated to about 1000° F. before insertion into the combustion chamber by a combination of preheat by the boiler air heater and regenerative heating by heat transfer from the liner. This air provides the secondary combustion air, and it is injected into the combustion chamber, in helical flow, through an annulus in the end wall of the chamber. The 1000° F. air temperature assures rapid coal ignition under fuel rich conditions.

A primary fuel-air stream, secondary combustion air, and a sorbent for sulfur (limestone or equivalent) are injected into the chamber at an end wall, the primary fuel-air stream being introduced through a circular array of outlets. Secondary combustion air, entering the combustor through the above-mentioned annulus, propels suspended particles in helical flow toward the wall of the combustor.

Also disposed in a circular array in the end wall of the combustor, and spaced from the central axis of the combustor, are the outlets through which the sorbent may be injected into the chamber. The fuel-air mixture and the sorbent are therefore injected at locations radially inwardly of the moving body of secondary combustion air.

Coal fines may also be introduced to the chamber through the end wall through axially directed nozzles. These nozzles are located radially outwardly of the secondary combustion air and near the walls of the chamber (and, consequently, near the slag layer), to maximize coal ignition and devolatilization.

End injection of air and fuel produce gas flow and temperature fields which are more favorable to efficient coal combustion and sulfur capture than air-coal injection along the top sidewall, as in the prior commercial cyclones, or sidewall injection of air with end wall injection of coal at the axis of the cyclone, the latter arrangement being used in an advanced cyclone. (J. A. Hardgrove, "MHD Coal Fired Combustor", in Proceedings 9th Energy Technology Conference, Washington, D.C. February 1982.) Side injection of air, it has been found, produces flow recirculation which is detrimental to control of the temperature flow field in the cyclone, and axial injection of coal in prior combustor designs can result in the coal fines being carried out of the exit nozzle combustor by the central forced vortex flow field in the cyclone, without complete combustion.

A very thin slag layer (of several millimeters) can be maintained in the chamber by the precise temperature control attainable with air cooling, and rapid removal of slag from the chamber avoids reevolution of sulphur from the reacted limestone sorbent. Slag flow within the chamber is controlled by gravity. The slag is removed to a water-cooled slag tank, where it is quenched and fragmented, and then further broken up and withdrawn from the apparatus by an injection-type pump.

Combustion gasses leave the combustor chamber through an air-cooled exit nozzle assembly, lined internally with refractory material. The assembly allows the exit nozzle to operate at near adiabatic conditions.

For the purpose of illustrating the invention, there are shown in the drawings forms of the apparatus in accordance with the present invention, it being understood, however, that the invention is not limited to the precise arrangements and instrumentalities shown.

BRIEF DESCRIPTION OF THE DRAWINGS

FIG. 3 is a transverse cross-sectional view, taken along the line 3—3 in FIG. 2;

FIG. 4 is a transverse cross-sectional view, taken along the line 4—4 in FIG. 2;

FIG. 5 is a detail view, showing an example of a cooling air tube used in apparatus in accordance with the invention;

FIG. 6 is a detail view, showing aspects of the cooling air tubes for use in apparatus in accordance with the invention.

FIG. 9 is an end elevation view of the apparatus.

FIG. 10 is a partial detail view of the injector assembly showing the orientation of the solids injection tubes.

DETAILED DESCRIPTION

Figure 1:
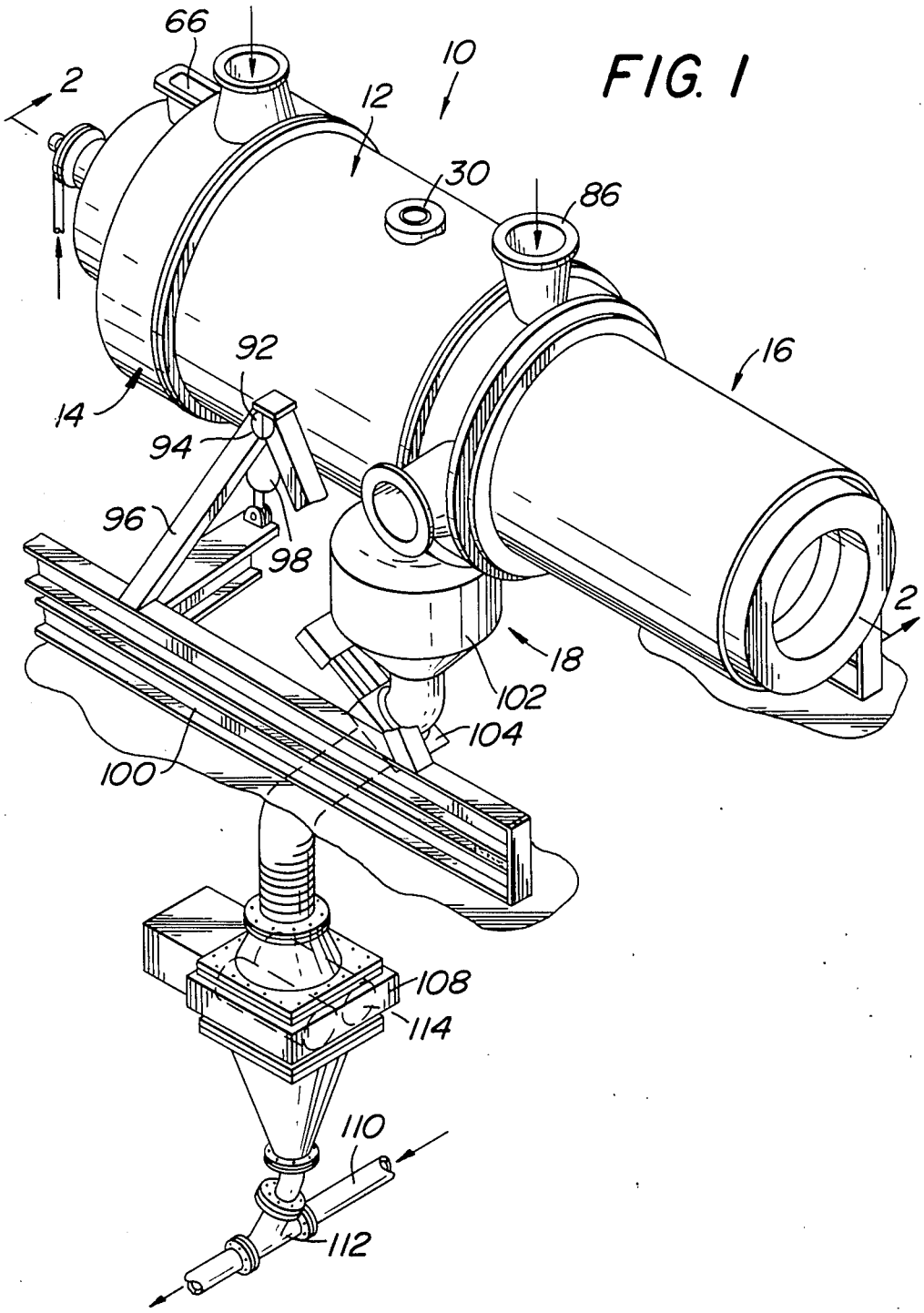
FIG. 1 is a perspective view of a cyclone combustor in accordance with the invention.
Figures 2, 2A:
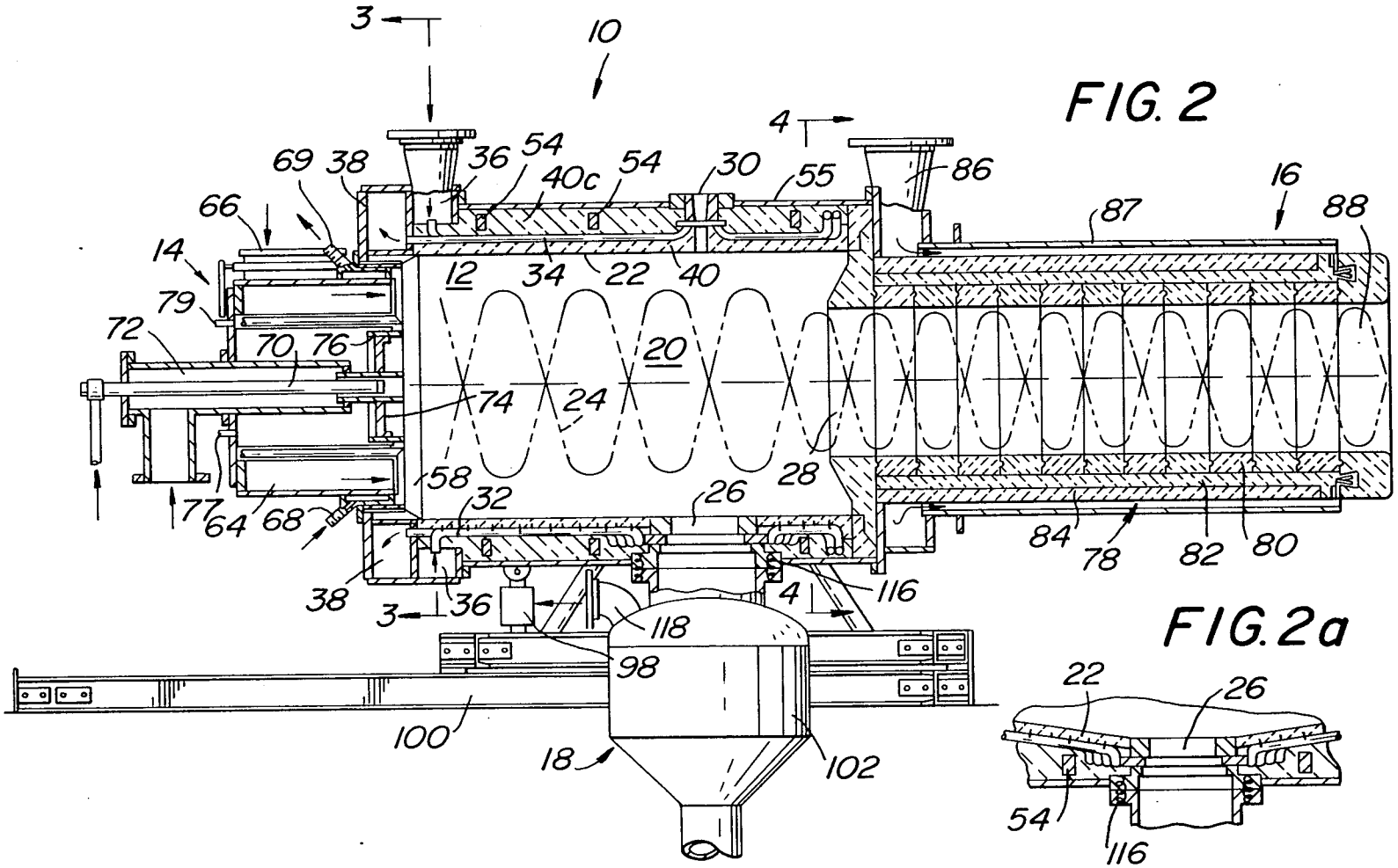
FIG. 2 is a longitudinal cross-sectional view, taken along the line 2—2 in FIG. 1.
FIG. 2*a* is a detail view of an alternative form of the invention.
Figure 7:
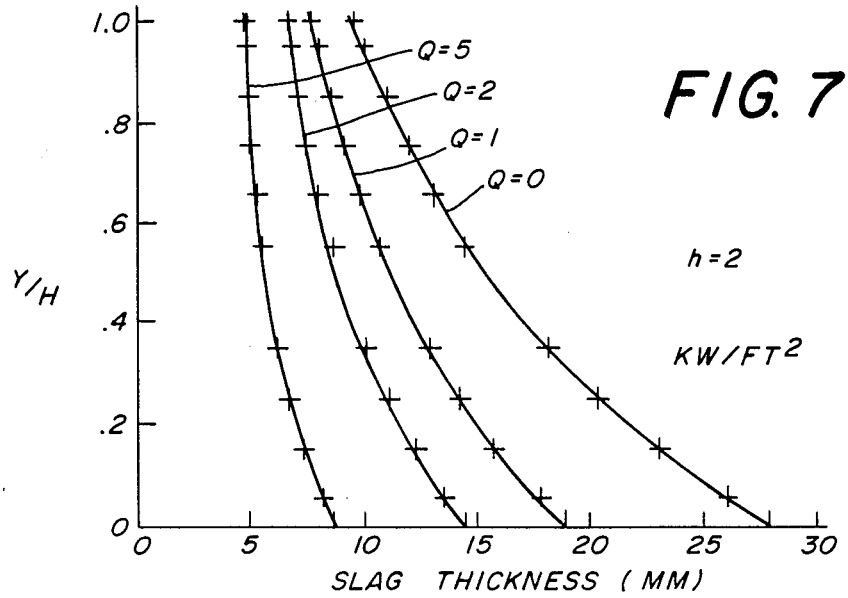
FIG. 7 is a graphic depiction, illustrative of the effect of slag layer thickness on the operation of apparatus in accordance with the invention.

Referring now to the drawings in detail, wherein like reference numerals indicate like elements, there is seen in FIGS. 1 and 2 cyclone coal combustor apparatus designated generally by the reference numeral 10.

The combustor apparatus 10 comprises four major subassemblies, each of which is described below. These are: a combustion chamber and liner assembly, designated generally by the reference numeral 12; an injector assembly, designated generally by the reference numeral 14; an exit nozzle assembly, designated generally by the reference numeral 16; and a slag tank assembly, designated generally by the reference numeral 18.

Air-Cooled Ceramic Lined Combustion Chamber

The main cylindrical body of the combustor is air cooled. The combustor apparatus 10 includes a cylindrical chamber or shell 20, the interior of which is coated with a non-sacrificial ceramic lining 22. The chamber 20 provides an enclosure in which helical gas flow, depicted by the dotted lines 24 in FIG. 2, can be established.

In communication with the chamber 20 is a slag tap 26, through which liquid slag may flow for removal to the slag tank assembly 18, and an outlet port 28, associated with the exit nozzle assembly 16, through which combustion products may pass from the combustor apparatus 10 to a boiler furnace box (not shown). A view and diagnostic port 30 allows for observation of conditions within the chamber or shell 20.

Air cooling tubes, of which the tubes 32 and 34, shown in FIG. 2, are exemplary, extend generally axially with respect to the chamber or shell 20 and are disposed at closely radially spaced locations around the outer periphery of the chamber 12. A plenum or manifold 36, which is in fluid communication with the interiors of the air cooling tubes, supplies cooling air to the tubes 32, 34 and the like. The air cooling tubes 32, 34 are so arranged as to also communicate with another plenum or manifold 38, from which the cooling air may exit. As will be explained in greater detail below, the air cooling tubes 32, 34 are partly embedded in and intimately associated with a refractory medium 40 from which the lining 22 is made.

In a presently preferred form of the combustor apparatus 10, the refractory medium 40 is fabricated, in a manner described below, from ceramic cement of the kind sold commercially as "Carbofrax 11L1". Microscopically, the medium 40 is a composite of two layers. As is seen in FIG. 3, a surface layer **40*a* of the refractory medium 40 is positioned to contact liquid slag within the chamber or shell 20. The surface layer 40*a* is, in one presently preferred embodiment, about 0.75 inch thick and is of substantially pure ceramic. Another, outer, layer 40*b* of refractory medium 40, also about 0.75 inch thick, contacts the air cooling tubes 32, 34. The tubes 32, 34 are backed by a layer 40*c*** of loose ceramic powder to minimize heat loss to the environment.

Referring to FIG. 5, each of the air cooling tubes 32, 34 includes a supply leg 42 associated with the plenum 36, which is an inlet manifold, and a return leg 44, associated with the plenum 38, which is a return manifold. A hairpin bend or bight portion 46 connects the supply and return legs 42, 44. The tubes are so arranged that a supply leg 42 of one tube lies adjacent a return leg 44 of another tube, so that supply and return legs alternate around the periphery of the chamber or shell 20.

As is seen in FIGS. 3 and 4, air cooling tubes, such as the exemplary tubes 32, 34, are disposed about the entire periphery of the chamber or shell 20, and in their totality, form a substantially continuous cylindrical shell or enclosure for the lining 22. The supply and return legs 42, 44 of the air cooling tubes extend generally axially with respect to the chamber or shell 20, but those air cooling tubes which are aligned with or encounter the slag tap 26 or other irregularities in the chamber or shell 20, such as the port 30, are typically provided with irregular segments 48 by which they may be detoured around the irregularities.

Intimate contact between the ceramic lining 22, and specifically the outer layer **40*b* of the refractory medium 40 which makes up the ceramic lining 22, is obtained through the use of threaded metal studs 50, affixed by welding to the air cooling tubes 32, 34. The studs 50 seen in FIGS. 2, 3, 4 and 6, project radially outwardly with respect to the longitudinal axes of the supply legs 42 of the air cooling tubes 32, 34, and when the air cooling tubes 32, 34 are installed in the combustor apparatus 10, they project generally inwardly toward the central axis of the chamber or shell 20**.

As is perhaps best seen in FIG. 4 (where exemplary studs 50 are shown), the studs 50 permeate the outer layer **40*b* of the refractory medium. In so doing, they enhance heat transfer between the air cooling tubes 32, 34 and the lining 22, and also serve to anchor and maintain the integrity of the lining 22. The studs 50, which in a presently preferred form of the apparatus are approximately 0.75 inch high and 0.375 inch in diameter are preferably welded only to the relatively cool supply legs 42 of the air cooling tubes 32, 34. Such an arrangement minimizes the possibility of cracking of the refractory medium 40 due to differential expansion between the metal air cooling tubes 32, 34 and the refractory medium 40 of the lining 22**.

In order to achieve desired heat transfer rates (on the order of 50,000 BTU/hr - per ft.$^2$ in a presently contemplated 50 million BTU/hr combustor) without unacceptable pressure losses, the air cooling tubes 32, 34 are internally finned, as indicated by the reference numeral 52 in FIG. 6. With internally smooth tubes, the maximum heat transfer would be about 30,000 BTU/hr - ft.$^2$ In one presently preferred form of the apparatus, the air cooling tubes 32, 34 are specified as the alloy known as "Incoloy 800H", having a 1.5 inch O.D. and a maximum temperature specification of 1800° F. The studs 50 are of the same material. When assembled, as is perhaps best seen in FIGS. 3 and 4, a supply leg 42, providing cold inlet air, is located adjacent to a return leg 44, carrying hot outlet air. The inlet air is drawn from the boiler air pre-heat system (not shown), and tempered with additional air as required to meet the maximum tube temperature specification.

The air cooling tubes 32, 34 are held in place by sets of rings or hoops, advantageously located at several positions along the length of the chamber or shell 20. A typical hoop 54 is depicted in FIG. 2. The hoops, such as the hoop 54, allow for thermal expansion of the entire liner assembly 12, as well as easy removal of the liner assembly 12 for overhaul. The space between the hoops is filled with porous refractory filler material **40*c*, and the entire structure is enclosed by a metal shell 55**.

The primary considerations in the design of the combustor 10 and its liner assembly 12 (including the ceramic lining 22) are as follows:

(a) The inside surfaces of the ceramic lining 22 must operate at a temperature at which the slag is suitably liquid;

(b) The maximum allowable tube wall temperature in the air cooling tubes 32, etc. must not be exceeded in any of the combustor operating modes;

(c) The cooling air pressure drop should be sufficiently low from the standpoint of the overall energy considerations of the boiler system;

(d) The cooling air flow should be matched to the combustion air flow; and (e) the cooling air outlet temperature should be as high as possible to enhance the rate of coal devolatilization.

Another important design objective is that a wide range of inside wall surface temperatures be achievable under a wide range of wall heat fluxes.

The design of the liner assembly 12 may be based on an analysis familiar to those skilled in the art, which includes a cooling air pressure drop model and a two-dimensional wall heat transfer analysis. This thermal-hydraulic analysis is performed to arrive at a set of design specifications for the liner of the present example of the combustor 10, namely a 50 MMBTU/hr. cyclone, at an inside wall temperature of 2500° F. and a wall heat flux of 50,000 BTU/hr-ft$^2$. To illustrates operating flexibility around the design point, operating conditions are shown in FIG. 12 for an inside wall temperature (i.e. the interface between the liquid slag and the hot side of the ceramic liner 22), of 2500° F. and for heat fluxes in the range of 20,000–50,000 BTU/hr-ft$^2$.

More specifically the above-mentioned thermal-hydraulic design model for the combustor liner assembly 12 consists of (a) an internal flow model for the air flow in the cooling tubes which is used to size the tubes and evaluate the air pressure drop and the air-side heat transfer coefficient, and (b) a two-dimensional model of the liner heat transfer, which is used to determine the thickness of the ceramic liner 22 to achieve the desired inside liner temperature and the peak metal tube temperatures.

For design purposes, the wall heat transfer may be uncoupled from the combustion process by treating the wall heat flux as a specified value, which is selected on the basis of reported heat transfer losses in other cyclone combustors. However, it should be noted, that with the use of air cooling of the ceramic liner 22 and with variable air pre-heat, and by adjusting the thickness of the slag layer, the design heat transfer is to some extent a parameter that can be pre-specified.

Figure 12:
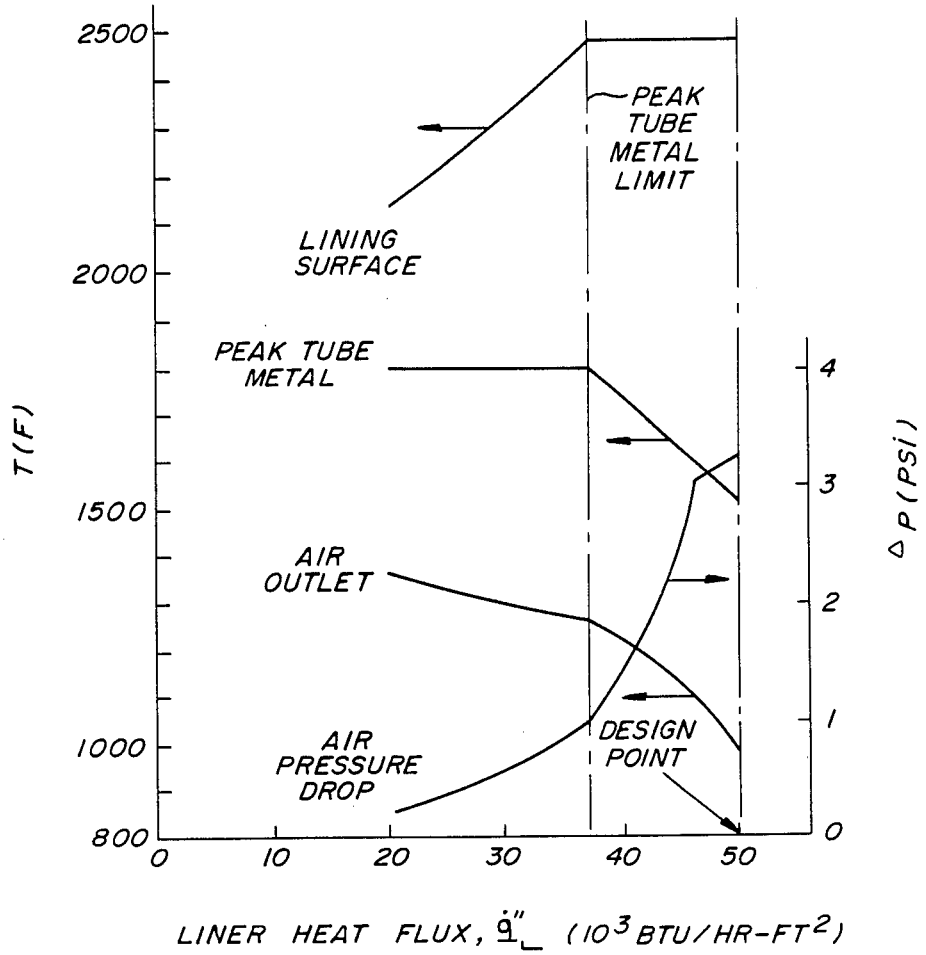
FIG. 12 is a graphic depiction, illustrative of the temperature and pressure response for a combustor design to changes in certain operating variables.

Referring now to FIG. 12, in this particular example it was desired to obtain 1,000° F. cooling outlet temperature with a moderate pressure drop of about 3 psi. Under these conditions, lowering of the wall heat flux limits combustor operation to about 37,500 BTU/hr.-ft.$^2$, because below this wall heat flux value the temperature limits for the metallic elements will be exceeded unless the liner surface temperature is reduced. Such a reduction, however, will result in unacceptable freezing of the slag layer. By manipulating the several variables, for example, by lowering the secondary air inlet temperature to the cooling tubes 32, etc., one can obtain a different and acceptable, set of operating conditions. The foregoing illustrates the flexibility of the air cooling techniques used in the present apparatus.

The technique by which the slag may be used to modify the wall heat transfer is as follows. For the preferred operating conditions, the slag temperature is maintained by air cooling in a range in which it flows down the side walls of the chamber 20 toward the bottom wall, and along the bottom wall toward the slag tap 26 due to the configuration of the bottom wall or the tilt of the chamber 20. Due to the thickness of the slag layer at the bottom wall as compared to the sides, the heat transfer capabilities at the bottom of the chamber 20 are less than at the side walls. By changing the variables which affect the flow characteristics of the slag, the thickness of the slag layer, and hence the heat transfer capabilities of the entire chamber 20, may be varied.

Fuel and Oxidizer Injection

Referring to FIGS. 2 and 3, the injector assembly 14 will now be described in detail.

Primary air, which is used to transport pulverized coal into the combustor 10, is introduced by injection through tubes or nozzles 56, preferably eight in number, disposed in array in the end wall 58 of the combustor 10. Additional tubes 60, preferably four in number, are used to inject pulverized limestone or an equivalent sorbent for sulphur capture into the chamber 20.

An annulus 62 in the end wall 58 provides an inlet for secondary air. The tubes 56 and 60 are disposed in a circular array, spaced from the longitudinal axis of the chamber 20 by a radius which is less than the radius of the annulus 62.

Dry pulverized coal may be transported to the chamber 20 in a dense phase, in which the coal to air mass flow ratio is about four or five to one. Such an arrangement is necessary because, to prevent preignition of the coal during transport, the primary transport air must be maintained at no more than about 160° F. Large volumes of air at this temperature will excessively cool the hot secondary air, and thereby delay coal ignition and devolatilization.

A coal-water slurry may also be used for coal transport, in which case a standard atomization tip (not illustrated) would be required at the point of injection of the slurry into the chamber 20.

As is depicted in phantom in FIG. 3, the injection direction of the coal and limestone, through the tubes 56 and 60 is at an oblique angle, preferably 45° F. toward the cylindrical wall of the chamber 20. The above mentioned radius of the array of the tubes 56 and 60 is selected to be in the region where the tangential gas flow is as in a free vortex, namely, a region in which the product of the tangential velocity and the combustor radius is constant. Such a flow field occurs at a radius greater than about one-third of the inner radius of the combustor 20.

Referring again to FIGS. 2 and 3, four additional tubes 64 emerge from the end wall 58 in a circular array at a radius slightly smaller than the internal radius of the combustion chamber 20. The tubes 64 are used to convey with air, coal fines (particles less than about 20–30 microns in diameter) into the hot gas zone near the molten slag layer inside the combustion chamber. The fines serve to increase the combustion gas temperature in the zone adjacent to the end wall 58 of the combustion chamber 20, a condition which serves to increase the ignition rate of the main body of the coal fuel, injected through the tubes 56.

Referring again to FIG. 2, secondary air enters the injector assembly 14 tangentially, through two ports 66 (only one of which is seen in FIG. 2), each of which contains a flap or damper valve 67 (as shown in FIG. 9) by which the volume of the secondary air and the stoichiometry of the combusion chamber 20 is controlled. The air enters the annulus 62, which is cooled by two water circuits entering at 68 and at 77, and leaving at 69 and 79. The annulus is sized to achieve a tangential air velocity at the inlet to the chamber 20 of about 300 ft/sec.

An oil gun 70, preferably of up to 20 million BTU/hr capacity, is used to pre-heat the combustion chamber 20 at start up and is located at the center of the injector assembly 14. A separate, gas fired oil ignition tube (not shown) is provided. Some of the air needed for oil combustion is provided through the tube 72 and the balance is provided through the annulus 62.

Completing the injector assembly is a water cooled ceramic lined surface 74, providing a part of the end wall 58. Referring to FIG. 2, the surface 74 comprises a ceramic, sold commercially as "Emerald Ram" cement, backed by "LINS 50" ceramic cement. These materials are supported in a metal casing 76, the back of which is water cooled. Water cooling is desirable in contemplated combustor designs in the 50 to 100 million BTUs/hr range. Smaller combustors will not require water cooling of the end wall 58, annulus 62 and surrounding structures. The water cooling of the end plate 74 and annulus 62 is so arranged as to prevent the formation of local steam pockets, which would reduce the local heat transfer rate to a point which could lead to materials failure. Referring to FIG. 2, the cooling water enters at 77, and exits at 79, and flows toward the surface 74. It then reverses itself through an annulus.

Exit Nozzle Assembly

The attachment of combustors, such as the combustor apparatus 10, to certain boilers requires breaching the boilers' water wall, the tubes of the breached water wall being diverted so as to maintain their continuity. The depth of the breach is such that a fairly long exit nozzle is required. In the illustrated embodiment, the nozzle length can be approximately eight feet, although, it should be noted, not all boilers require such lengthy exit nozzles.

In combustors which have long nozzles, it is essential that the combustion gases not suffer a significant temperature drop in passing through the nozzle. In the presently contemplated apparatus, this design objective is achieved by the use of a composite inner ceramic liner. Thus, referring to FIG. 2, wherein the exit nozzle assembly 16 is illustrated, the ceramic liner, designated generally by the reference numeral 78, comprises a layer of dense "Monofrax E" ceramic tiles 80, backed by a cement structure consisting of either "Alfrax 66" (high density alumina) 82 or an inner layer of "Alfrax 66" 82 backed by an outer layer of a porous cement such as "LINS 50", designated in FIG. 2 by the reference numeral 84. For an overall ceramic liner thickness of less than eight inches, it has been found possible to design the exit nozzle assembly 16 to operate at near adiabatic conditions, so that combustion gases undergo less than a 100° F. temperature drop in the nozzle assembly 16.

Figure 8:
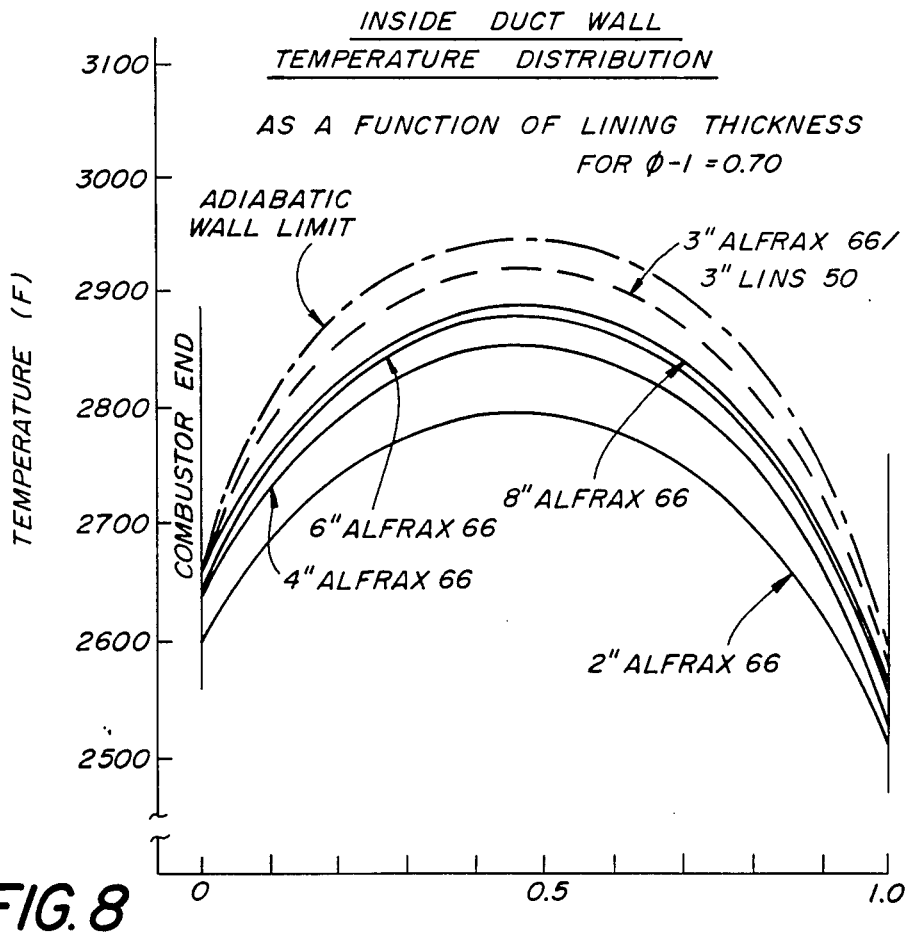
FIG. 8 is a graphic depiction of the results of a heat transfer analysis of a nozzle assembly in accordance with the invention.

FIG. 8 shows the heat transfer analysis of an exit nozzle assembly 16, which includes the radiation loss through the ends of the nozzle. It will be seen that various combinations of composite ceramics can be used to allow the inner nozzle wall to operate close to the adiabatic temperature of the combustion gases.

Figure 11:
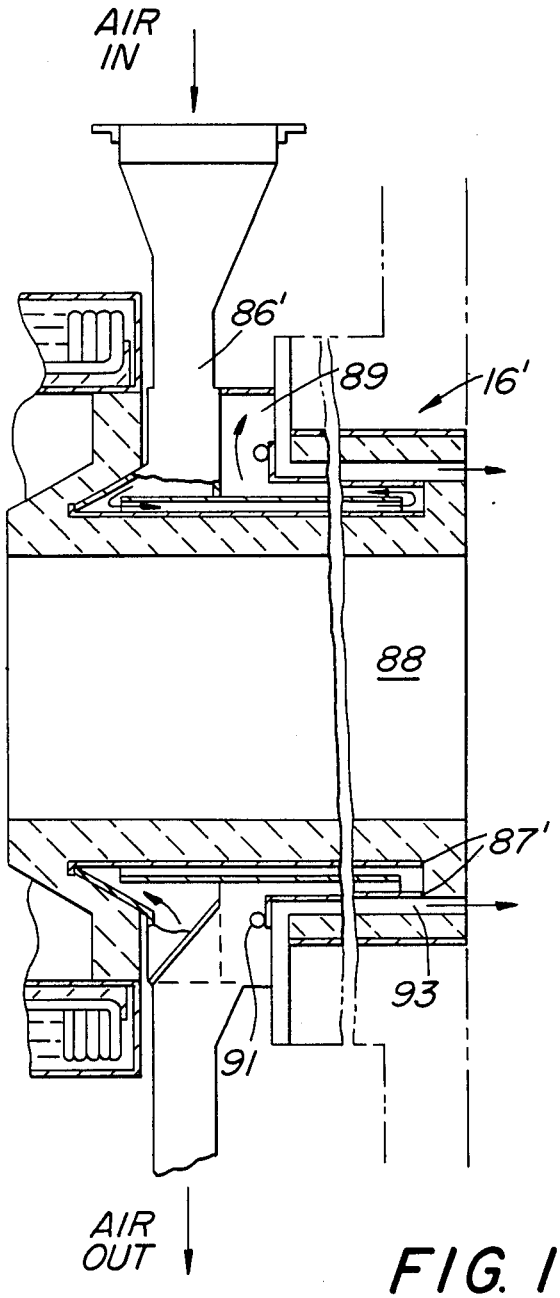
FIG. 11 is a partial longitudinal cross-sectional view of an alternative form of nozzle assembly, suitable for applications where the nozzle cooling air cannot be injected directly into the boiler due to $NO_x$ control requirements.

The design of the air cooling of the nozzle assembly 16 shown in FIG. 2 is for the case in which the cooling air is used as tertiary air for final combustion of the exhaust gases of the combustor 10. For optimum $NO_x$ control, however, the nozzle cooling air, which enters the apparatus 10 through an inlet plenum 86 and passes through a metal shell 87, should be injected into the boiler at a locality far from the outlet 88 through which the relatively fuel rich combustion gases enter the boiler. FIG. 11 illustrates an alternative form of exit nozzle assembly, designated by the reference numeral 16', in which the cooling air may selectively be rerouted to such a locality or for other uses.

In the exit nozzle 16', a concentric pair of shells 87' are provided in fluid communication with an inlet plenum 86' and an outlet plenum 89. Associated with the outlet plenum 89 is a selectively controllable damper valve 91, the positioning of which directs flow at the cooling air to an annulus 93, from which the cooling air may emerge adjacent to the combustion gas outlet 88, or to another location remote from the outlet 88. The other location may be, for optimum $NO_x$ control, a boiler opening remote from the one with which the outlet 88 is associated, or an air inlet for other uses.

The heat fluxes to the nozzle wall, in the presently contemplated design, are low, in the range of 1,000 to 7,000 BTU/hr - ft.$^2$ As an alternative, therefore, one can water cool the exit nozzle assembly 16 if no use for the nozzle cooling air exists.

Slag Tap and Slag Tank Assembly

Rapid removal of slag from the combustor is critical to the retention of captured sulfur in the slag and to prevention of freezing of the slag on the internal parts of the ceramic liner. The present design achieves rapid drainage of the slag down the side walls of the combustion chamber in a manner such that the slag thickness is maintained in the range of one to three millimeters for efficient drainage and heat transfer.

A horizontal bottom for the chamber or shell 20 will allow an undesirable accumulation of slag and prevent its rapid removal through the slag path 26. Referring to FIG. 2*a*, the bottom wall of the chamber or shell 20 may advantageously be slanted, on the order of about 10°, toward the slag tap 26 to achieve slag flow for drainage. The ideal slant, however, for a given composition of coal and given combustion conditions is known to vary. Therefore, in one presently contemplated embodiment of the invention, best seen in FIGS. 1 and 2, the outer shell of the combustor apparatus 10 is provided with a pair of horizontally extending bearing surfaces or trunnions 92. The trunnions 92 are supported by complemental bearing surfaces 94 on a carriage support structure 96. Hydraulic actuator means 98, coupled to the carriage 96 and the chamber or shell 20, selectively pivots the shell 20 with respect to the carriage 96 to provide a desired slant for the bottom wall. In this manner, the slant for optimum slag drainage can be established upon installation of the combustor apparatus, when the nature of the fuel and particular service conditions are established.

Because tilting of the chamber 20 also affects the elevation of the exit nozzle assembly 16, it is desirable that the carriage 96 be mounted on a fixed support structure 100, and movable with respect to the support structure 100 so as to adjust the position of the combustor apparatus 10 in a direction parallel to the longitudinal axis of the chamber or shell 20. The combined adjustments supplied by rotation of the chamber or shell 20 with respect to the carriage 96 by means of the trunnions 92 and adjustment of the position of the carriage 96 with respect to the fixed support 100 permits a desired flexibility in the mounting of the combustor apparatus 10.

Referring again to FIGS. 1 and 2, disposed below the slag tap 26, and in communication with it, is a slag tank 102, at the bottom of which is disposed a gate valve 104. A conduit 106 extends from the exhaust side of the valve 104 to a clinker grinder 108. The clinker grinder, in turn, exhausts to a drainage line 110, associated with a jet pump 112.

The slag tank 102 is a conventional water filled tank, which includes a spray cooler (not shown) for the combustion gas flow (approximately one percent of the combustion gas mass flow) that is drawn into the slag tank 102. Slag is quenched and fractured in the tank 102. The clinker grinder 108 is a commercial crusher unit of a conventional type, consisting of two rotating cylinders 114 with interlocking teeth. Typically, in the operation of the apparatus, the clinker grinder 108 will be activated for one minute every ten minutes as accumulated slag is released from the slag tank 102 by opening of the gate valve 104. The jet pump 112 is a commercial unit, which ejects the ground slag through the drainage line 110 which may be a four inch pipe to slag holding tanks (not shown).

A problem relating to slag removal is the well-known tendency of the slag to freeze in the slag tap 26, thus blocking it. Electric heating of the tap 26, as by a heater 116 (which requires less than about 10 watts/ft.$^2$), overcomes this tendency. Freezing of the slag can also be controlled by the use of a large generally rectangular slag tap opening, on the order of one foot long in the axial direction and six inches wide in the transverse direction, lined with ceramic inserts. Also, if necessary, a commercial slag wiper, not shown, may be associated with the slag tank 102 to break any slag that freezes in the slag tap 26. Since electric heaters such as the heater 116 may have limited service lives under the operating conditions which exist at the slag tap 26, an alternative approach is to use a small gas heater to heat the bottom of the slag tap 26. In such an arrangement, hot gases produced by the heater would be directed through passages in the ceramic blocks lining the opening of the tap 26. Alternatively, the hot gases would simply be directed to the back of the blocks.

The above-described slag tank arrangement provides for the combustor apparatus 10, including the slag tank assembly 18, a desired minimum total vertical height. This allows the installation, if desired, of a vertical column of combustor apparatus 10 on a large boiler in a small vertical space at the bottom of the boiler's furnace chamber. Such an arrangement allows for optimum $NO_x$ control.

The above-described slag tank assembly can accommodate 90% removal of slag and limestone at a calcium/sulphur ratio of 3 for Kaiparowits coal, with a combustor operating at a 100 million BTU/hr capacity. In operation, a 25 gpm water spray rate is required to cool the one percent combustion gas bypass flow and an additional 25 gpm of water is required to cool the slag and reacted limestone. The aggregate water flow at the 50 gpm rate is continuously withdrawn, through an outlet 118 seen in FIG. 2, at the side of the tank. As indicated above, the valve 104 is open for one minute every ten minutes to withdraw the accumulated solids through the clinker grinder 108 and jet pump 112. The inlet to the jet pump, in the contemplated arrangement, draws 350 gpm of water and the outlet 400 gpm. Such high flow rates prevent blockage in the drainage lines, such as the drainage line 110, leading to the slag holding tanks.

Mounting of the Combustor

Referring again to FIGS. 1 and 2, the arrangement by which the combustor 10 is mounted adjacent to the wall of a boiler is seen. Due to the thermal expansion of the boiler in a vertical direction, the combustor 10 cannot be attached directly to the furnace wall. The carriage 96 and fixed support 100, it should be understood, are preferably attached to building structure apart from the boiler, thus allowing for three dimensional motion of the combustor apparatus 10 with respect to the boiler. After start up of the combustor apparatus 10, and after the apparatus 10 reaches full operating temperature, the apparatus 10 may be inserted into an opening in the furnace designed to accommodate the apparatus 10. The apparatus 10 may also be removed from the furnace prior to cooldown. In routine thermal cycling of the furnace, however, removal or insertion of the combustor apparatus should not be necessary, as the opening in the furnace wall will be made, as is known to those skilled in the art, sufficiently large to accommodate dimensional changes due to thermal expansion under such conditions.

The illustrated technique for mounting the combustor is shown by way of example. Others, such as hanging of the combustor from roof supports, may be used if necessary.

The present invention may be embodied in other specific forms without departing from its spirit or essential attributes. Accordingly, reference should be made to the appended claims rather than the foregoing specification as indicating the scope of the invention.

We claim:

1. Cyclone coal combustor apparatus comprising a generally horizontally disposed cylindrical chamber having an inlet end and an exhaust end, means at said inlet end of injecting into said combustor a fuel-air mixture and a secondary air stream, a non-sacrificial refractory liner disposed within said chamber, conduit means for a gaseous coolant disposed within said chamber, and coolant conducting means in fluid communication with said conduit means whereby said coolant may be introduced into and withdrawn from said conduit means, said conduit means comprising a plurality of metallic tubes surrounding and at least partly embedded within said liner, said tubes comprising generally U-shaped tubes having first and second leg portions interconnected by bight portions, said leg portions extending generally axially with respect to said chamber, said means whereby said coolant may be introduced into and withdrawn from said conduit means being disposed adjacent to the inlet end of said chamber and said bight portions of said tubes being disposed adjacent the outlet end of said chamber.

2. Apparatus in accordance with claim 1, and metallic stud members affixed to said tubes, said stud members being surrounded by and in intimate contact with said liner.

3. Apparatus in accordance with claim 1, and a slag tap in fluid communication with the bottom wall of said combustor for rapid removal of slag from said combustor, and a slag tank coupled to and in fluid communication with said slag tap.

4. Apparatus in accordance with claim 3, wherein a bottom wall of said chamber slopes downwardly toward said slag tap, whereby slag may be made to flow by gravity toward said tap.

5. Apparatus in accordance with claim 3, wherein said chamber is mounted for rotation about a horizontal axis generally perpendicular to the longitudinal axis of said chamber, and actuator means for rotating said chamber about said axis, whereby the slope of said chamber may be adjusted.

6. Apparatus in accordance with claim 5, and support means for said chamber, said support means comprising means to facilitate selective movement of said apparatus in axial direction so as to position said apparatus with respect to the wall of a boiler.

7. Apparatus in accordance with claim 3, wherein said slag tap is disposed adjacent to the exhaust end of said chamber, said tap being generally rectangular in cross-section and lined with ceramic means having auxiliary heating means associated therewith.

8. Apparatus in accordance with claim 7, wherein said ceramic means comprises a plurality of ceramic plates, said auxiliary heating means applying heat to said plates so that free flow of slag is assured under all operating conditions of the apparatus.

9. Apparatus in accordance with claim 1, and an exit nozzle in fluid communication with the exhaust end of said chamber, said exit nozzle being so insulated as to operate at near-adiabatic conditions.

10. Apparatus in accordance with claim 9 wherein said exit nozzle comprises an inner assembly of ceramic material, surrounded by a metal annulus, said annulus carrying a heated air stream to cool said nozzle.

11. Cyclone coal combustor apparatus comprising a generally horizontally disposed cylindrical chamber and a non-sacrificial refractory liner disposed within said chamber, air cooling means disposed within said chamber and at least partly embedded within said liner, said air cooling means comprising a plurality of generally U-shaped tubes having first and second leg portions interconnected by bight portions, said leg portions extending in a direction generally axially with respect to said chamber and comprising respective supply and return legs, said air cooling tubes being so arranged that a supply leg of one tube lies adjacent a return leg of another tube, said tubes forming a generally cylindrical enclosure for said liner.

12. Apparatus in accordance with claim 11, wherein stud members are affixed to said tubes and extend into said liner, whereby said studs provide a heat transfer medium and anchor means between said tubes and said liner.

13. Apparatus in accordance with claim 12, wherein said studs are affixed to only said supply legs of said tubes.

14. Cyclone coal combustor apparatus comprising a generally horizontally disposed cylindrical chamber having an upstream inlet end and an exhaust end downstream of said inlet end, means at said inlet end for injecting into said combustor a fuel-air mixture, a secondary air stream, a sorbent for the removal of sulfur compounds, and coal fines, a non-sacrificial refractory liner disposed within said chamber, generally U-shaped conduit means for a gaseous coolant disposed within said chamber, and coolant conducting means in fluid communication with said conduit means whereby said coolant may be introduced into and withdrawn from said conduit means, said conduit means comprising a plurality of air-cooled metal tubes disposed around the outer periphery of said liner and providing a backing for said liner, said means whereby said coolant may be introduced into and withdrawn from said conduit means comprising inlet and outlet plenums disposed adjacent said upstream end of said chamber, said conduit means comprising tubes having first and second leg portions extending, respectively, downstream and upstream with respect to said chamber, respective first and second leg portions being interconnected by bight portions, said bight portions being disposed adjacent said downstream end of said chamber, said conduit means having their respective first leg portions in fluid communication with said inlet plenum and respective second leg portions in fluid communication with said outlet plenum, and said first and second leg portions being so arranged that first and second leg portions are adjacent to each other.

15. Apparatus in accordance with claim 14, wherein said chamber is mounted for rotation about a horizontal axis generally perpendicular to the longitudinal axis of said chamber, and actuator means for rotating said chamber about said axis, whereby the slope of said chamber may be adjusted.

16. Apparatus in accordance with claim 15, and a slag tap in fluid communication with the bottom wall of said chamber for rapid removal of slag from said combustor, and auxiliary heating means associated with said slag tap.

17. Apparatus in accordance with claim 14, and an exit nozzle in fluid communication with the exhaust end of said chamber, said exit nozzle being so insulated as to operate at near-adiabatic conditions and comprising an inner assembly of ceramic material, surrounded by a metal annulus, said annulus carrying a heated air stream to cool said nozzle and comprising a pair of shells, and valve means for selectively routing cooling air to one or the other of said shells, whereby said cooling air may be introduced directly into a boiler opening or, alternatively, into a boiler opening remote from the outlet of said exit nozzle.

18. Apparatus in accordance with claim 17, wherein said chamber is mounted for rotation about a horizontal axis generally perpendicular to the longitudinal axis of said chamber, and actuator means for rotating said chamber about said axis, whereby the slope of said chamber may be adjusted.

19. Apparatus in accordance with claim 18, and a slag tap in fluid communication with the bottom wall of said chamber for rapid removal of slag from said combustor, and auxiliary heating means associated with said slag tap.

20. Cyclone coal combustor apparatus comprising a generally horizontally disposed cylindrical chamber and a non-sacrificial refractory liner disposed within said chamber, air cooling means disposed within said chamber and at least partly embedded within said liner, said air cooling means comprising a plurality of generally U-shaped tubes having first and second leg portions interconnected by bight portions, said leg portions extending generally axially with respect to said chamber and comprising respective supply and return legs, said tubes being so arranged that a supply leg of one tube lies adjacent a return leg of another tube and said tubes form a generally cylindrical enclosure for said liner, stud members affixed to said supply legs of said tubes and extending into said liner, whereby said studs provide a heat transfer medium and anchor means between said tubes and said liner, first coolant conducting means in fluid communication with said supply legs of said tubes, and second coolant conducting means in fluid communication with said return legs of said tubes, whereby coolant may be introduced into and withdrawn from said tubes, said chamber having an inlet end and an exhaust end, said coolant conducting means in fluid communication with said supply and said return legs being disposed adjacent said inlet end, and said bight portions of said tubes being disposed adjacent to said outlet end, said chamber having an end wall at said inlet end, means in said end wall for introducing into said chamber a coal-air mixture, a pulverized sorbent for sulfur compounds in the fuel, and a stream of secondary air, said means for introducing into said chamber a stream of secondary air comprising an annulus in said end wall and in fluid communication with said second coolant conducting means, said means for injecting into said chamber the fuel-air mixture and the sorbent being disposed radially inwardly with respect to said annulus, whereby helical flow of the secondary air causes solids within said shell to impinge upon said liner.

21. Apparatus in accordance with claim 20, wherein said means for injecting into said chamber the coal-air mixture and the sorbent comprise nozzles for said solids are disposed in said end wall and directed tangentially with respect to a radius of said end wall and said shell and at an angle of approximately 45° with respect to the longitudinal axis of said shell.

22. Apparatus in accordance with claim 21, wherein said nozzles are disposed in a generally circular array in said end wall.

23. Apparatus in accordance with claim 22, and a plurality of nozzles in said end wall for introducing into said chamber coal fines, said last-mentioned nozzles being disposed in said end wall radially outwardly with respect to said annulus and near said liner.

24. Apparatus in accordance with claim 23, wherein at least part of said end wall is constructed of ceramic composite material, the back of which is water-cooled.

25. Apparatus in accordance with claim 24, wherein a centrally located ash-free fuel injector is disposed in said end wall, a portion of the combustion air for said injector being used to preheat said chamber and the balance of the combustion air for said injector being provided by said annulus for said secondary air stream.

26. Cyclone coal combustor apparatus comprising a generally horizontally disposed cylindrical chamber having an inlet end and an exhaust end, means at said inlet end for injecting into said combustor a fuel-air mixture and secondary air stream, a non-sacrificial refractory liner disposed within said chamber, conduit means for a gaseous coolant disposed within said chamber, and coolant conducting means in fluid communication with said conduit means whereby said coolant may be introduced into and withdrawn from said conduit means, said conduit means comprising a plurality of metallic tubes surrounding and at least partly embedded within said liner, and an exit nozzle in fluid communication with the exhaust end of said chamber, said exit nozzle being so insulated as to operate at near-adiabatic conditions, said exit nozzle comprising an inner assembly of ceramic material, surrounded by a metal annulus, said annulus carrying a heated air stream to cool said nozzle, and said annulus comprising a pair of shells and valve means for selectively routing cooling air to one or the other of said shells, whereby said cooling air may selectively be introduced directly into a boiler opening or, alternatively, into a boiler opening remote from the outlet of said exit nozzle.

* * * * *